US005852893A

United States Patent [19]

Fujimori

[11] Patent Number: 5,852,893

[45] Date of Patent: Dec. 29, 1998

[54] GUN FOR APPRECIATION AND PRODUCTION METHOD THEREOF

[76] Inventor: Kenji Fujimori, 3263-1, Osachi, Okaya-shi, Nagano, Japan

[21] Appl. No.: 843,562

[22] Filed: Apr. 18, 1997

[30] Foreign Application Priority Data

Apr. 26, 1996 [JP] Japan ..... 8-004594

[51] Int. Cl.[6] ..... F41C 27/00

[52] U.S. Cl. ..... 42/106

[58] Field of Search ..... 42/106, 70.11, 42/96, 54; 89/14.5

[56] References Cited

U.S. PATENT DOCUMENTS

| | | | |
|---|---|---|---|
| 2,887,807 | 5/1959 | Santangelo | 42/1 |
| 3,022,598 | 2/1962 | Wikstrom | 42/66 |
| 3,360,880 | 1/1968 | Finnegan | 42/66 |
| 3,999,320 | 12/1976 | Zaubzer | 42/58 |
| 4,023,294 | 5/1977 | Knopp | 42/1 LP |
| 4,136,476 | 1/1979 | Hetrick | 42/1 LP |
| 4,969,284 | 11/1990 | Healey et al. | 42/70.11 |
| 5,048,211 | 9/1991 | Hepp | 42/70.11 |
| 5,450,685 | 9/1995 | Peterson | 42/70.11 |

*Primary Examiner*—Harold J. Tudor
*Assistant Examiner*—Meena Chelliah
*Attorney, Agent, or Firm*—Dorn, McEachran, Jambor & Keating

[57] ABSTRACT

The invention relates to a gun for appreciation, which is constructed by machining some parts thereof so that the same can not be used as a real gun, and comprises a barrel having a chamber for generating a propulsion force of a bullet and a bullet passing bore formed so that a bullet is caused to pass through, and a frame equipped with a supporting section for supporting and fixing said barrel, wherein an opening is drilled at a wall of said barrel, for example, said chamber, a metallic rod is inserted into said bullet passing bore, and said barrel and said metallic rod are fixed at said opening.

7 Claims, 8 Drawing Sheets

11a
10
12
12a
11
13
14
20
30
31
32a
32
32a
42
33a
33A
33b
41
33B
33
43

GUN FOR APPRECIATION AND PRODUCTION METHOD THEREOF

TECHNICAL FIELD OF THE INVENTION

The present invention relates to guns for appreciation and production method thereof, and especially relates to a technique by which guns are additionally machined and treated so that they are not able to used as guns any more and no bullet can be released even though their components are modified.

BACKGROUND OF THE INVENION

Conventionally, although guns and rifles are produced in a plurality of countries, there are many countries where severe control regulations are proclaimed for the public peace. For example, in Japan, since importing guns is prohibited as a rule, guns can not be brought into Japan unless a special permit is issued by the Government.

On the other hand, there are many people who want to have guns for appreciation, some magazines pertaining to guns are published, and model guns which are very similar to real guns are produced and sold. Furthermore, there are guns for appreciation, which are formed so as to disable firing cartridges by additionally machining real guns, differing from such imitation guns. In such countries where such guns are permitted, actual transactions have been carried out with respect to model guns (for appreciation).

In cases where real guns are formed as those for appreciation by further machining, it is necessary to make the entirety of guns unusable and to additionally machine the components thereof so that they can not be used for production of real guns, especially in countries where the gun regulations are very severe, as in Japan. Such a machining technology is usually very important to render guns for appreciation unusable as a real gun, regardless of the gun regulations.

In a conventional machining and treating method of guns, it was necessary to give small machining to every component of a gun so as to render the components unusable. Furthermore, since there is a case where a gun for appreciation will be able to be constructed again so as to be able to fire cartridges by re-modifying the same unless considerable machining is carried out for basically important components of a gun such as a barrel, frame, etc., the conventional methods are very cumbersome. Therefore there causes a problem by which it takes high costs in machining and treating guns for appreciation.

Still furthermore, by modifying the barrel, frame, etc., to a large extent, the outward appearance of a gun, and a sense of holding the same may be lost or greatly changed, whereby the value of a gun for appreciation may be lowered.

SUMMARY OF THE INVENTION

The present invention relates to a gun for appreciation to which some machining is given to be made unusable as a real gun and comprising a barrel including a chamber for generating a propulsion force of a bullet and a bullet passing bore formed so as to cause bullets to pass therethrough, and a frame equipped with a supporting section at which said barrel is supported and fixed, wherein an opening is drilled at the wall of said barrel, a metallic rod is inserted into said bullet passing bore and said chamber, and said barrel and said metallic rod are fixed at said opening.

In said gun for appreciation, the barrel is made unusable by providing an opening and a metallic rod is securely fixed in the barrel. Furthermore, even though a re-modification such as removing the metallic rod, it will be impossible due to the existence of said opening and said fixing part that the gun for appreciation will be re-utilized as a real gun, and with the invention the modification cost is able to be lowered.

Herein, it is favorable that said opening is formed at a wall of said chamber. Because the chamber is the most important portion of the barrel as to basic function of a gun.

It is also favorable that said frame is provided with a gripping section, and said frame is provided with a notched part and/or a cut-off part at the boundary area between said supporting section and said gripping section of the frame, and said notched part and said cut-off part being partially formed so that said supporting section and the gripping section are not separated from each other.

In this case, since it is possible to lower the strength of the boundary area between the supporting section and the gripping section of the frame by forming the notched part and/or cut-off part, it is possible that the corresponding boundary area can be destroyed by firing a cartridge. Therefore, if a gun for appreciation according to the invention is used as a real gun, the frame itself may be destroyed, the bullet may not hit the target and the gun may not be used again. Furthermore, it is possible to prevent guns for appreciation from being further re-modified for a real gun by virtue of only slight machined parts described above.

Furthermore, the invention also provides a method for producing guns for appreciation, which are respectively provided with a barrel constructed to be unusable as a real gun by giving some machining to a real gun, wherein after an opening is drilled at the wall of said barrel and a metallic rod is inserted inside said barrel, said barrel and said metallic rod are fixed to each other at said opening.

In this case, there is a case where said opening is formed at the wall of the chamber of said barrel or a case where said opening is formed at the wall of barrel.

Furthermore, the invention further provides a gun for appreciation, which is constructed to be unusable by giving some machining to a real gun, comprising a cylinder provided with cartridge accommodation bores for generating a propulsion force of a bullet, a barrel provided with a bullet passing bore formed to cause a bullet to pass therethrough, and a frame equipped with a supporting section for supporting and fixing said barrel, wherein an opening is drilled at the wall of said barrel, a metallic rod is inserted into said bullet passing bore of said barrel, and said barrel and said metallic rod are fixed at said opening.

In this case, it is preferable that a cavity is formed by scooping out a inner part at which said cartridge accommodation bores are formed in said cylinder.

Furthermore, guns which will be source materials of guns for appreciation according to the invention may be real guns, other guns, for example, accurate model guns which may have a possibility to hold a function as a gun by the modification thereof.

The invention is able to solve the abovementioned problems existing in the prior arts, and it is therefore an object of the invention to provide a safe gun for appreciation, in which the functions thereof as a real gun can be securely deprived of by machining a real gun and the components thereof can not be utilized for production or assembling of another real gun, and to provide a novel production method of a real gun, which is able to lower the treating cost and a reliable machining and treating method which does not lower the value of a gun for appreciation by a process which does not greatly affect the outward appearance of the gun.

PREFERRED EMBODIMENT OF THE INVENTION

Next, a description is given of preferred embodiments of a gun for appreciation according to the invention with reference to the drawings attached herewith. Each of the preferred embodiments described below shows an example in which a pistol of various kinds of guns is machined. However, the invention is applicable to not only pistols but also various kinds of guns such as rifles, shotguns, etc. Furthermore, the same is applicable to imitation guns such as model guns. A type of a pistol shown in connection with the first preferred embodiment of the invention is an automatic pistol, which is available in the market, for example, "Walther P-38 Auto" as a trademark. And there are several models which are similar to this type, for example, respective models of "Walther P-5, P-88, PP, PPK and PPK(S)". Still furthermore, there are many pistols for which the machining process identical to that according to the invention can be carried out, for example, "MAUSER Model 1896", "BROWNING Model 1910 Auto", "COLT Model 1911-1911A1 Auto", etc.

Figure 1:
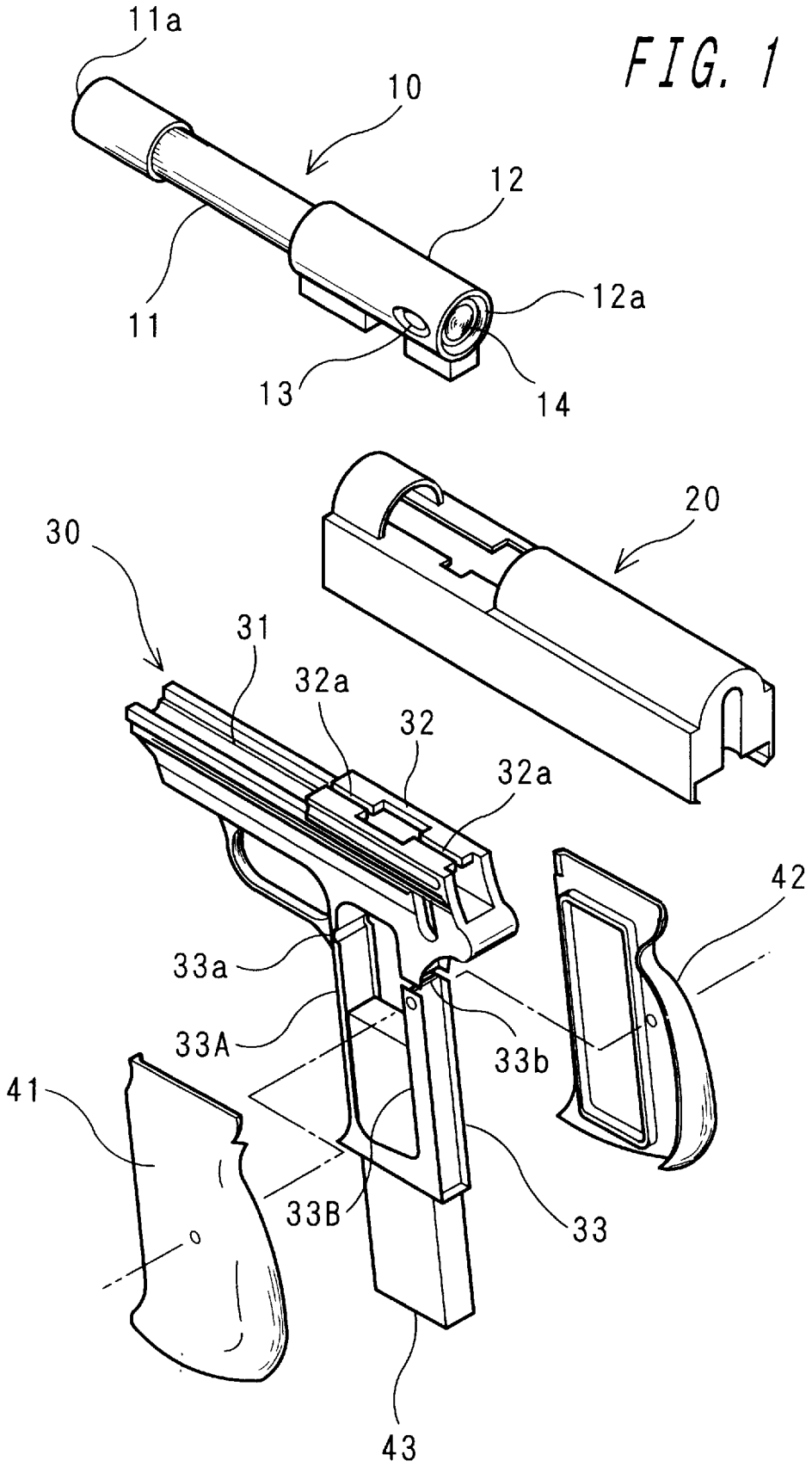
FIG. 1 is a disassembled perspective view of major components of a first preferred embodiment of guns for appreciation and production method thereof according to the invention.

FIG. 1 is a disassembled perspective view showing the outline of major components of a pistol which is a kind of guns, wherein many small components are omitted. Herein, a barrel 10 consists of a bored portion 11 for defining a bullet path, and a chamber 12 connected to the rearward of the bored portion 11. The barrel 10 is shown with its small mechanisms for charging and discharging cartridges omitted.

A slider 20 is a member for charging cartridges into the barrel and discharging the same therefrom. A frame 30 is constructed so that the barrel 10 and slider 20 are able to be mounted, and the same comprises a barrel supporting section 31 for fixing the barrel 10, a rear supporting section 32 disposed rearward of the barrel supporting section 31 and formed so as to be engaged with the slider 20, and a gripping section 33 extending downward of the barrel supporting section 31. A pair of left and right grip panels 41,42 formed of synthetic resin are provided at both the sides of the gripping sections 33 of the frame 30 so as to be screwed therein. Furthermore, it is constructed that a magazine 43 having a plurality of cartridges charged is able to be inserted from the bottom end of the gripping section 33.

In a machining and treating method according to the preferred embodiment for a pistol constructed as described above, grinding and cutting are also given to a number of small components (not illustrated) in addition to the components illustrated in the drawings. Although the details of grinding and cutting adapted to a number of small components (not illustrated) are omitted, such machining and treating have auxiliary objects for depriving of the functions of the corresponding pistol as a real gun, and furthermore their main object is placed in that such small components will not be able to be utilized as components of other guns. Because these small components may be easily produced.

Figure 2:
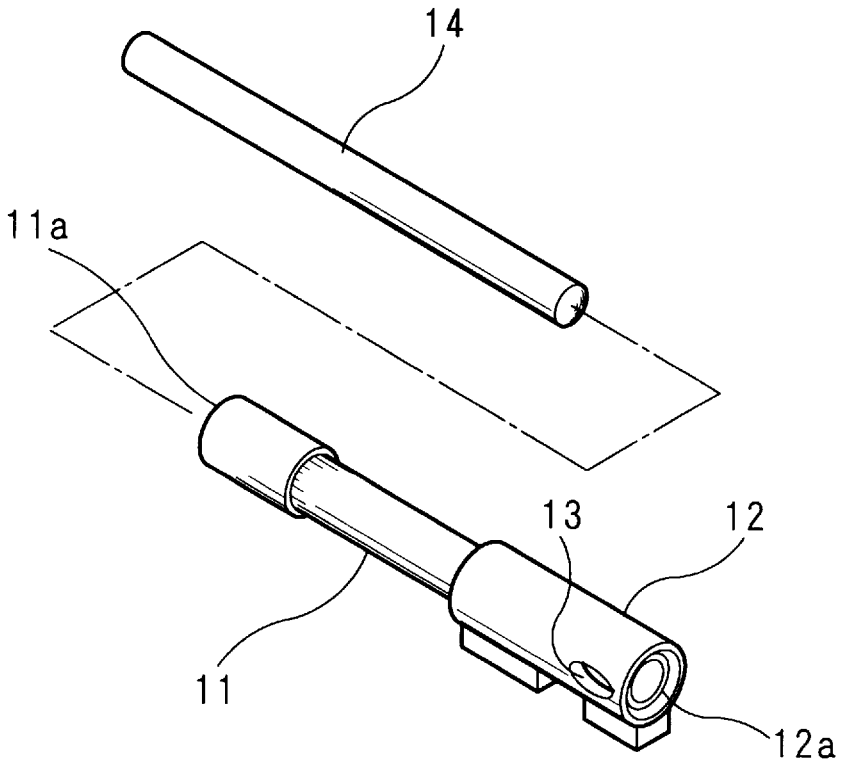
FIG. 2 is a disassembled perspective view showing a machining process of a barrel according to the first preferred embodiment.

The most important machining in the preferred embodiment is a machining of the barrel since the barrel 10 includes a chamber 12 for firing cartridges and a bullet passing bore 11 provided with a bored portion for leading bullets forward. An opening 13 is formed at the side of the chamber 12 of the barrel 10 by drilling the wall of the chamber 12, and a metallic rod 14 made of an iron rod is inserted into the bored portion 11 and chamber 12. FIG. 2 shows a state where such machining has been completed.

With the metallic rod 14 inserted, the rear end thereof reaches the inside of the chamber 12 and the front end thereof is disposed slightly inward of the bullet releasing port 11*a* located at the tip end of the bored portion 11. The metallic rod 14 is machined to a predetermined length so as to reach the bullet releasing port 11*a* to the inside of the chamber 12. The part of the metallic rod 14 which is inserted into the inside of the chamber 12 is fixed to the edge of the opening 13 secured at the wall of the chamber 12 by welding.

In the abovementioned machining and treating, by drilling the opening 13 at the chamber 12, the barrel can not be used any more. That is, since the chamber 12 which is one of the most important components of the barrel, no gun can be constituted unless the strength of this chamber can be obtained. Even though the opening 13 is clogged by a certain process, it is impossible that the section thereof stands against a high pressure when firing a cartridge.

Furthermore, by inserting a metallic rod 14 into the inside of the barrel 10 and welding the same thereat, the barrel can not be easily re-modified as the original barrel, and at the same time the barrel 10 can not retain its original strength even though the rod 14 is eliminated by cutting off the welded portion. With the preferred embodiment, even though the metallic rod 14 is eliminated from the state where the same is welded to the edge of the opening 13 in this preferred embodiment, the opening 13 and the remaining traces of welding will seriously influence the chamber 12, and the re-modification for a real gun will be substantially impossible.

The abovementioned metallic rod 14 may be welded to various points in addition to the part corresponding to the opening 13 described above. The most effective point of them is the bullet releasing port 11*a* (inside thereof). That is, if the front end of the metallic rod 14 is welded to this point, it is made impossible to take out the metallic rod 14 from the bored portion 11 and simultaneously even though the metallic rod 14 is removed therefrom, traces of the welding may remain on the inner surface of the bored portion 11, and it is remarkably difficult for the barrel to be used for a real gun.

The welding of the barrel 10 and metallic rod 14 may be carried out at, for example, the rear opening port 12*a* in addition to the above part. Still furthermore, it is also possible to drill the other wall of the barrel and adequately weld the metallic rod 14 to the barrel 10.

The position of an opening 13 drilled at the chamber 12 is not limited to the side wall of the chamber 12 as shown in FIG. 1 and FIG. 2, and the opening 13 may be formed at a side wall in any direction of the chamber 12 if the opening does not inherently exist in the corresponding real gun.

Figure 3:
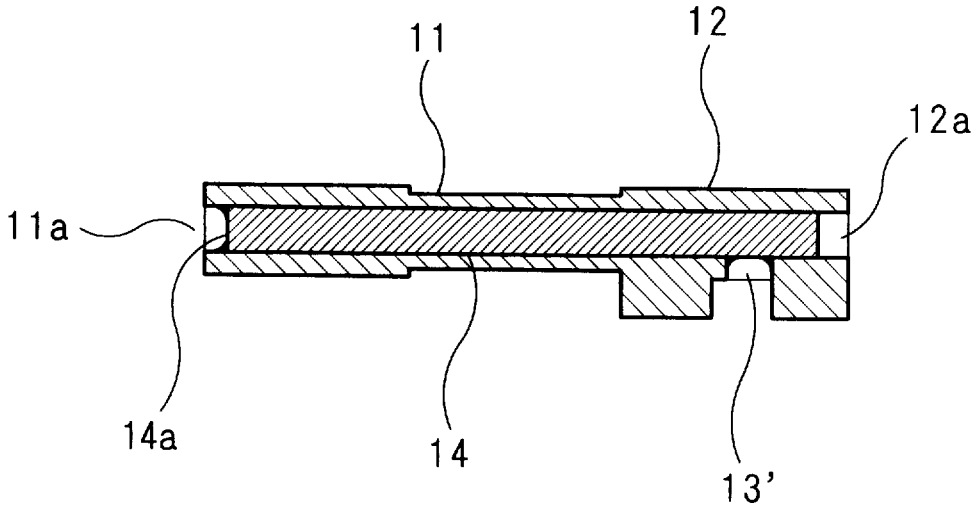
FIG. 3 is a longitudinally sectional view showing a sectional structure of a barrel which is partially different from the first preferred embodiment.

For example, as shown in FIG. 3, an opening 13' may be formed at the bottom of the chamber 12. In this case, since the opening 13' will be formed at a position where it can not be seen from outside when the pistol is assembled, the value as a gun for appreciation will be increased. Furthermore, the value as a gun for appreciation may be increased by the front end 14*a* of the metallic rod 14 being disposed inside the bullet releasing port 11*a* and the front end 14*a* thereof being welded to the inside of the barrel 11.

Furthermore, in order to achieve an object of increasing the value as a gun for appreciation by forming an opening at a position where the opening can not be seen from the outside, it is necessary to select an adequate position of an opening according to the structure of a gun since the structure of guns are diversified.

Machining applied to the frame 30 is also another important factor in the preferred embodiment. In this preferred embodiment, a longitudinal groove 32*a* is formed, which extends in the bullet releasing direction (along center axial line) at the bridging part which connects the left and right side sections of the rear supporting section 32 (that is, the part located rearward of the chamber 12 in an assembled pistol) of the frame 30. Thereby, the holding strength between the left and right wall portions of the frame 30 can be lowered, whereby the frame 30 is broken by firing a cartridge. Furthermore, grooves and notches formed so as to have such an object may be formed at the barrel supporting section 31. In any case, since a structure which influences and decreases the strength is formed in the vicinity of the chamber 12 at the supporting section (this supporting section includes the barrel supporting section 31 and rear supporting section 32.) which supports the barrel, the strength of the frame itself is deteriorated and will not be durable as a real gun any more. Even though such a machined pistol is used for firing a cartridge, the frame itself is destroyed. Therefore, it is possible to prevent further re-modification for a real gun and to secure a safe gun for appreciation.

Figure 4:
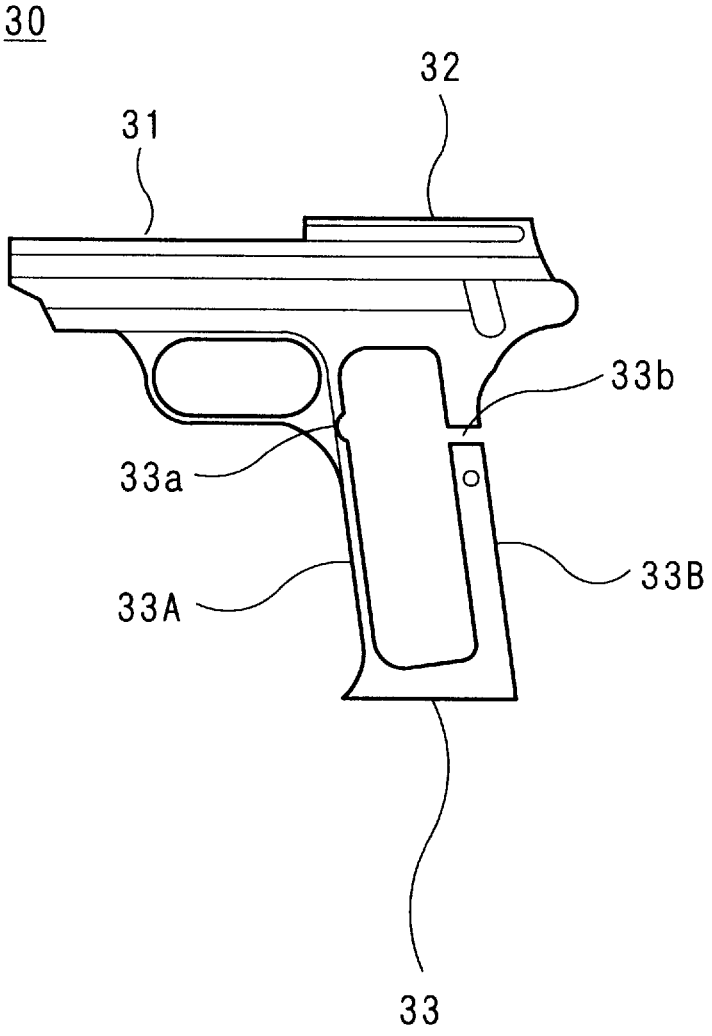
FIG. 4 is a side elevational view showing the structure of a frame of the first preferred embodiment.

An more important machining position of the frame 30 is the boundary area between the abovementioned barrel supporting section 31 and the gripping section 33 downwardly extending from the barrel supporting section 31. As shown in FIG. 1 and FIG. 4, the gripping section 33 is usually provided with supporting frames 33A and 33B, one of which is located at the front side thereof, and the other of which is located at the rear side thereof. A notched part 33*a* is formed from the inside at the root of the supporting frame 33A, and a cut-off part 33*b* is formed a little downward of the formed position of the notched part 33*a* at the supporting frame 33B.

The notched part 33*a* is formed to decrease the strength of the root part of the supporting frame 33A, and the cut-off part 33*b* is formed to decrease the strength of the supporting frame 33B. These parts 33*a* and 33*b* are constructed so that the boundary area between the barrel supporting section 31 and the gripping section 33 is broken by firing a cartridge. Since the outward appearance of a gun can not be kept if the notched part and cut-off part are formed so that the barrel supporting section 31 is separated from the gripping section 33 at the frame 30, they must be partially formed at the boundary area between the barrel supporting section 31 and gripping section 33 so that the barrel supporting section 31 and the gripping section 33 are not separated from each other.

Although the front side of the supporting frame 33A is exposed as the face opposite the trigger (not illustrated), the notched part 33*a* is formed at only the inside of the supporting frame 33A. Therefore, the same does not appear outside by attaching grip panels 41, 42. Furthermore, since the rear side of the supporting 33B is covered up by the grip panels 41,42 shown in FIG. 1, the cut-off part 33*b* does not appear outside. Therefore, the machining do not invite any change on the outward appearance, whereby the value of appreciation will not be lowered.

Figure 5:
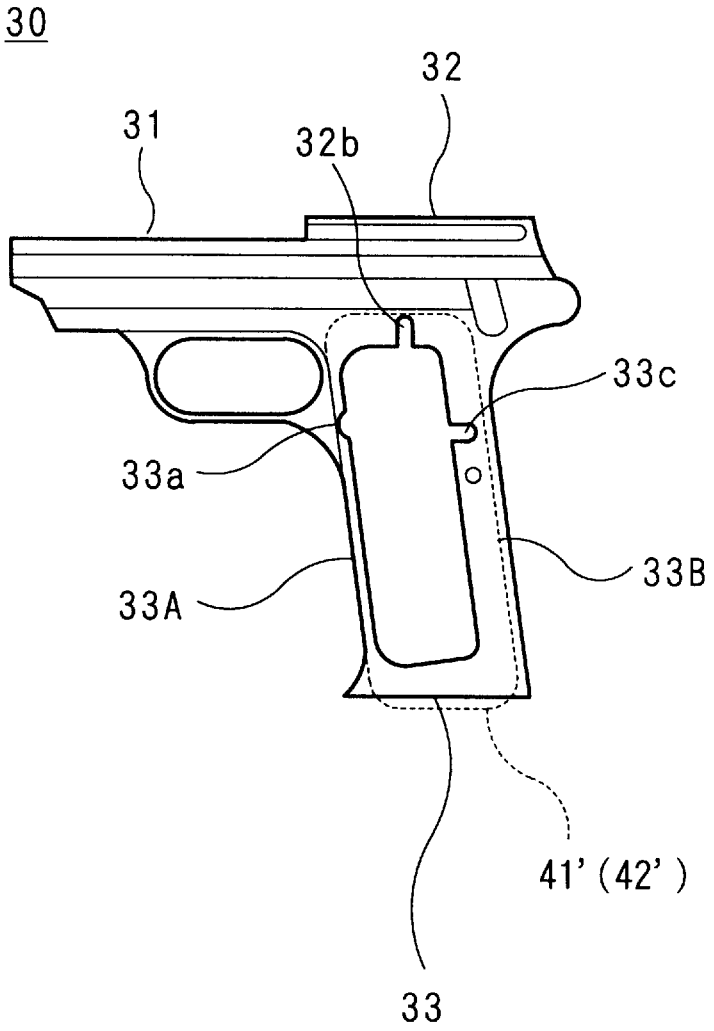
FIG. 5 is a side elevational view showing the structure of another frame which is different from the first preferred embodiment.

FIG. 5 shows a modified example of the above preferred embodiment. In a pistol of such a type where the grip panels 41'(42') is constructed so as not to cover up the rear side of the supporting section 33B, differing from the grip panels 41,42 shown in FIG. 1, the notched part 33*c* is formed without forming the cut-off part 33*b*. In this case, since the cut-off part appears on the rear side of the gripping section if the cut-off part shown in FIG. 4 is formed, the notched part 33*c* is formed by cutting deep from inside of the supporting section 33B.

As pistols to which this modification is applicable, there are, for example, "Lugar Model 1908 Auto", "Japanese Nambu Type 14 Auto", "Japanese Type 94 Auto", etc., the rear wall of the frame 30 of which is exposed.

Although there is no problem in a case where a sufficient lowering of the strength of the frame 30 is accomplished by the processing pattern shown in FIG. 5, there are cases where the strength can not be sufficiently lowered with only the notched parts 33*a* and 33*c*, depending on some frame structures. In these cases, it is possible to lower the strength by further increasing the number of notched parts. Although such additional notched parts may be formed at the supporting frame 33B, they may be formed inside at the lowermost portion of the supporting section like the notched part 32*b* in FIG. 5. Needless to say, it is preferable that the notched part 32*b* is constructed so as to be covered up by the grip panels 41',42'.

As described above, by employing a notched part or a cut-off part at the supporting frame 33A in the front side of the gripping section 33 and at the supporting frame 33B in the rear side thereof, it is possible to greatly lower the strength of the gripping section 33, and if, for example, it is attempted to fire a cartridge, the part at which the notched part and/or cut-off part are provided may be broken to cause the bullet to upwardly miss the mark. Therefore, it is possible to prevent further re-modification of an appreciation gun for a real gun.

The abovementioned notched parts 32*b*, 33*a*, 33*c* or cut-off part 33*b* are formed at the boundary area between the barrel supporting section 31 and the gripping section 33, whereby a breakage occurs between the rear supporting section 32 and the gripping section 33 by firing of a cartridge. The breakage causes a gun for appreciation not to be used as a real gun. Their forming portions and sizes of the parts 32*b,* 33*a,* 33*b,*33*c* may be variously made depending upon the kinds of guns, as far as similar actions and effects to those in the above description can be obtained.

Next, a description will be given of the second preferred embodiment according to the invention with reference to FIG. 6 to FIG. 10. A type of a gun shown in the second preferred embodiment is a revolver pistol. For example, there is "SMITH & WESSON Model 29 Revolver" as this type of gun, and there are "Colt 1851 Navy and 1862 Pocket Navy Revolver", "Single Action Army Revolver", etc. as types to which the second preferred embodiment is applicable.

Figure 6:
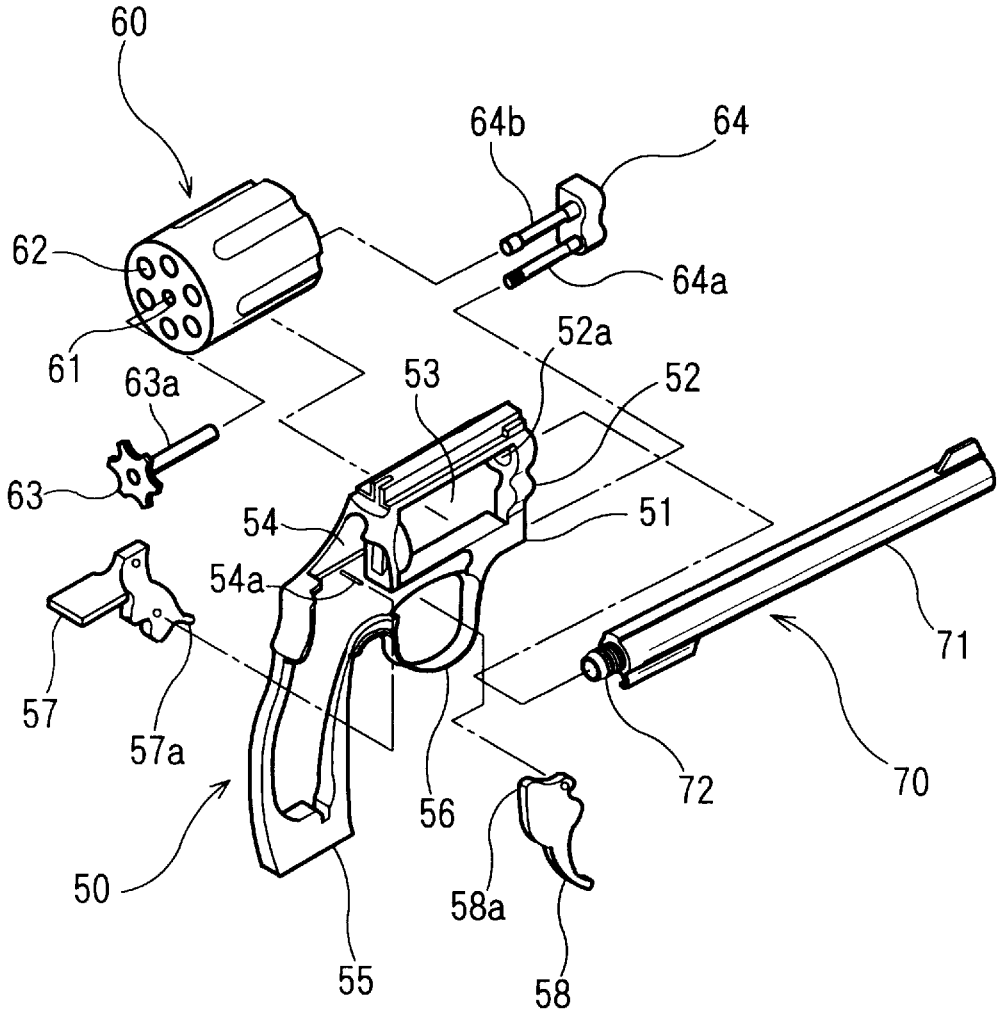
FIG. 6 is a disassembled perspective view of major components of a second preferred embodiment of guns for appreciation and production method thereof according to the invention.

The second preferred embodiment is, as shown in FIG. 6, provided with a cylinder 60 rotatably attached to the frame 50 and a barrel 70 screwed in the front part of the frame 50. In FIG. 6, a number of small components of the revolver are omitted.

The front supporting part 52 connected to the upper part of the front base 51 is provided at the frame 50, and a threaded hole 52*a* in which the barrel 70 is screwed is formed at the upper portion of the front supporting part 52. An opening 53 for accommodating the cylinder 60 is formed rearward of the front supporting part 52, and an operation mechanism accommodation part 54 to which a hammer 57 is attached is formed further rearward thereof. A gripping section 55 is provided downward of the operation mechanism accommodating part 54 while a trigger frame 56 for housing the trigger 58 is provided diagonally forward of the operation mechanism accommodating part 54.

The cylinder 60 is shaped to be columnar as a whole, and the same is provided with a center axial bore 61 formed so as to pass through in the axial direction at the center thereof and six cartridge accommodating bores 62 at the surrounding of the center axial bore 61 at an equal angle. An axial part 63*a* of the ejector (extractor) 63 is inserted into the center axial bore 61 from its rear, and the axial part 63*a* is connected to the supporting axis part 64*b* of the yoke 64 inserted into the center axial bore 61 from frontward. The rotating axis part 64*a* of the yoke 64 is inserted into the base 51 of the frame 50 and is rotatably attached with respect to the frame 50.

The barrel 70 consists of a barrel part 71 having a bullet passing bore penetrated in the axial direction, which is constructed to allow bullets to pass through, and a screw-in part 72 integrally attached to the rear end of the barrel part 71. Male threading is provided on the outer surface of the screw-in part 72, whereby the barrel 70 is fixed at the front part of the frame 50 by the screw-in part 72 being screwed in the threaded hole 52*a* secured at the front supporting part of the frame 50.

Figure 7:
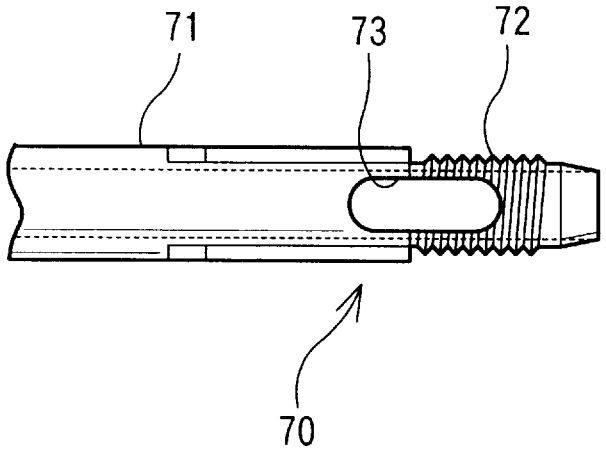
FIG. 7 is a disassembled perspective view showing a machining process of a barrel according to the second preferred embodiment.
Figure 8:
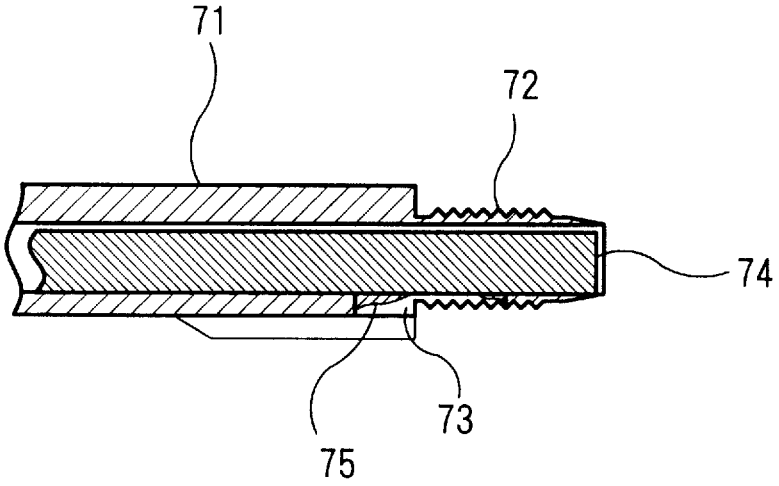
FIG. 8 is a disassembled perspective view showing a machined state of a barrel according to the second preferred embodiment.

As shown in FIG. 7, in the preferred embodiment, a opening 73 having elongated shape is formed at the bottom side of the part which extends over the barrel part 71 and screw-in part 72. Furthermore, as shown in FIG. 8, a metallic rod 74 having almost the same length as that of the barrel 70 is inserted into the bullet passing bore of the barrel 70, and the metallic rod 74 is fixed to the edge of the opening 73 by welding. Reference 75 shows a welded portion.

In this second preferred embodiment, the metallic rod 74 is welded to the edge of the opening 73 as in the first preferred embodiment. However, the opening is not only formed at the wall of the chamber but the opening 73 is also formed at the wall of the bullet passing bore through which a bullet discharged from the cylinder passes. In this method, since the wall of the bullet passing bore is opened and is welded to the metallic rod 74, it is impossible to substantially make further re-modification for a real gun. The forming position of an opening may not be limited to the position extending over the barrel 71 and the screw-in part 72. For example, the opening may be formed at the wall of the barrel 71 adjacent to the screw-in part 72 or may be formed at the wall of the screw-in part 72. In a case where an opening is formed at the wall of the barrel 71, it is preferable to form the opening as rearward of the barrel 71 as possible in view of making the re-modification for a real gun substantially difficult.

Most of the opening 73 in the second preferred embodiment is covered up by being screwed in the front supporting part 52 of the frame 50, and even though the rest of the opening is exposed from the frame 50, it does not constitute any problem in view of the outward appearance thereof because the same is formed on the bottom. Therefore, almost no adverse influence is given to the value as a gun for appreciation.

Figure 9A:
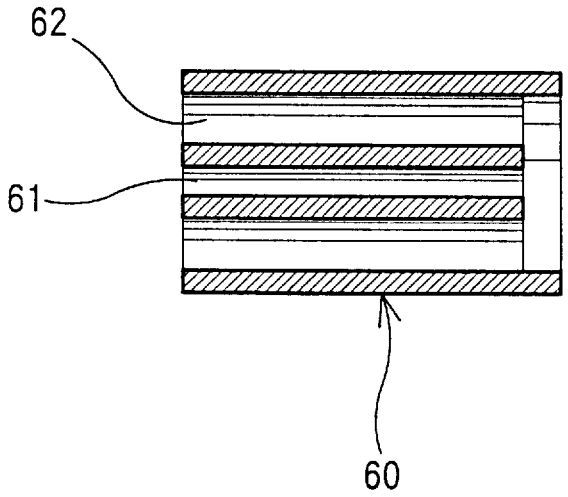
FIG. 9A is a longitudinal sectional view showing the original form of a cylinder according to the second preferred embodiment.
Figure 9B:
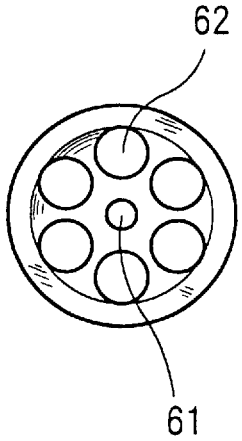
FIG. 9B is a rear side view of the embodiment of FIG. 9.
Figure 10A:
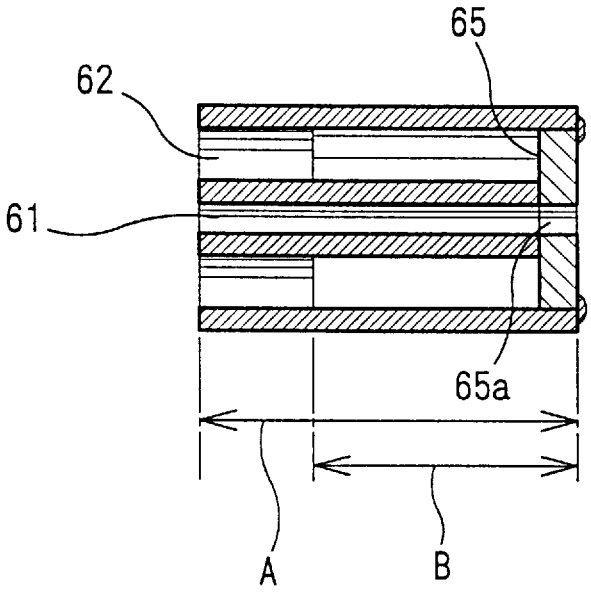
FIG. 10A is a longitudinal sectional view without a sealing plate showing a machined state of the cylinder according to the second preferred embodiment.
Figure 10B:
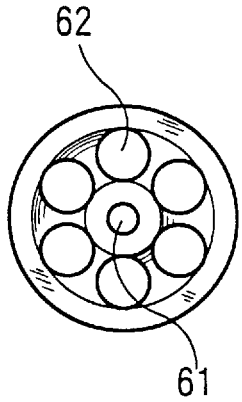
FIG. 10B is a rear side view of the second embodiment, as illustrated in FIG. 10A.

FIG. 9 is a cross-sectional view and rear side view showing the internal structure of the cylinder 60 before any machining is given according to the second preferred embodiment. Six cartridge accommodating bores 62 partitioned by internal walls are formed around the center axial bore 61 of the cylinder 60. Herein, the left direction illustrated in the cross-sectional view is the bullet discharging direction. In the preferred embodiment, as shown in FIG. 10, the inner wall rearward of the cylinder 60 is eliminated by cutting, and an internal cavity having a cross-section like a ring is formed by scooping out the inside at the rearward of the cylinder 60. Therefore, a disk-like sealing plate 35 having a center hole 65*a* is fitted to the large opening of the cavity formed at the rear end of the cylinder and the circumferential part of the sealing plate 65 is welded to the rear end of the cylinder 60.

Herein, it is preferable that the length B of the internal cavity (scoop out part) in the cylinder 60 is over half the total length of the cylinder, more favorably two-thirds thereof. Such machining makes almost impossible further re-modification for a real gun.

With such scooping out of the cylinder, the cylinder 60 can be made unusable without hardly sacrificing the outward appearance.

With the second preferred embodiment, firstly, the inside of the cylinder 60 is scooped out to break the function of the cartridge accommodating bores 62 in the cylinder 60 to make the inside empty. This is effective to kill the functions of the bullet accommodating bores 62, and the machining is very easy. Furthermore, with the preferred embodiment, a sealing plate 65 is fitted to the opening of the cavity thus formed and welded thereto. This makes more difficult further re-modification of the cylinder 60 for a real gun and simultaneously increases the value as a gun for appreciation. The sealing plate 60 is further provided with openings according to the shape of the cartridge accommodating bores 62 and images painted.

In the preferred embodiment, a hammer 57 shown in FIG. 6 is welded in the operation mechanism accommodating part 54 of the frame 50, and simultaneously a part of at least one of the engaging part of the hammer 57 and the engaging part of the 58*a* of the trigger 58 is cut off, whereby the hammer 57 and trigger 58 are not interlocked with each other. This also makes further more difficult the re-modification for a real gun and simultaneously make the hammer 57 and trigger 58 unusable as re-use components in any re-modification for a real gun.

According to the invention as described above, it is possible to make the use of the barrel impossible by formation of the opening and to insert and fix a metallic rod in the bullet passing bore of the barrel. Furthermore, even though the re-modification for removing the metallic rod is carried out, it is possible to prevent the gun from being used as a real gun due to existence of the opening and welded portion or to prevent such members from being used as components of a real gun due to the same reason. Still furthermore, it is easy to weld through the opening, whereby the modification cost to deprive a real gun of the inherent functions can be lowered.

What is claimed is:

1. A gun for appreciation constructed so that functions as a real gun are deprived of by machining parts of a gun and comprising:

a barrel having a chamber for generating a propulsion force of a bullet and a bullet passing bore formed so that a bullet is caused to pass through; and a frame equipped with a supporting section for supporting and fixing said chamber;

wherein an opening is drilled at a wall of said chamber, a metallic rod is inserted into said bullet passing bore and said chamber, and said barrel and said metallic rod are fixed at said opening.

2. A gun for appreciation constructed so that functions as a real gun are deprived of by machining parts of a gun and comprising:

a cylinder equipped with cartridge accommodating bores for generating a propulsion force of a bullet;

a barrel equipped with a bullet passing bore formed so that bullets are caused to pass through; and a frame equipped with a supporting section for supporting and fixing said barrel;

wherein an opening is drilled at a wall of said barrel, a metallic rod is inserted into said bullet passing bore, and said barrel and said metallic rod are fixed at said opening, and a cavity formed by scooping out an inner part of said cylinder in which said cartridge accommodating bores are formed.

3. A gun for appreciation as claimed in claim 2, wherein the opening of said cavity is sealed up.

4. A gun for appreciation constructed so that functions as a real gun are deprived of by machining parts of a gun and comprising:

a barrel having a chamber for generating a propulsion force of a bullet and a bullet passing bore formed so that a bullet is caused to pass through; and a frame equipped with a supporting section for supporting and fixing said barrel;

wherein an opening is drilled at a wall of said barrel, a metallic rod is inserted into said bullet passing bore and said chamber, and said barrel and said metallic rod are fixed at said opening, said metallic rod is positioned inwardly from the bullet releasing opening of said barrel and the front end of said metallic rod is fixed to the inner surface of said bullet passing bore of said barrel, and said frame is provided with a gripping section, and the boundary area between said supporting section and said gripping section in said frame is provided with a notched part and/or cut-off part which are partially formed so that said supporting section and said gripping section are not separated from each other.

5. A gun for appreciation constructed so that functions as a real gun are deprived of by machining parts of a gun and comprising:

a barrel having a chamber for generating a propulsion force of a bullet and a bullet passing bore formed so that a bullet is caused to pass through; and a frame equipped with a supporting section for supporting and fixing said barrel;

wherein an opening is drilled at a wall of said barrel, a metallic rod is inserted into said bullet passing bore and said chamber, and said barrel and said metallic rod are fixed at said opening, said frame is provided with a gripping section, and the boundary area between said supporting section and said gripping section in said frame is provided with a notched part and/or cut-off part which are partially formed so that said supporting section and said gripping section are not separated from each other.

6. A gun for appreciation as claimed in claim 5, wherein said notched part and/or said cut-off part are formed so as to be covered up by grip panels which enclose said gripping section.

7. A gun for appreciation constructed so that functions as a real gun are deprived of by machining parts of a gun and comprising:

a barrel having a chamber for generating a propulsion force of a bullet and a bullet passing bore formed so that a bullet is caused to pass through; and a frame equipped with a supporting section for supporting and fixing said barrel;

wherein an opening is drilled at a wall of said barrel, a metallic rod is inserted into said bullet passing bore and said chamber, and said barrel and said metallic rod are fixed at said opening, said frame is provided with a notched part and/or cut-off part, which are partially formed so that said frame is not separated from the other part and extend along center axial line of said barrel, at the position in the vicinity of said chamber at said supporting section.

* * * * *